US009766039B2

(12) United States Patent
Thomas et al.

(10) Patent No.: US 9,766,039 B2
(45) Date of Patent: Sep. 19, 2017

(54) RIFLE SCOPE HAVING A HOUSING MADE IN PART OF COMPOSITE MATERIAL AND IN PART OF METAL

(71) Applicant: Kruger Optical, Inc., Tiggard, OR (US)

(72) Inventors: Mark A. Thomas, Sisters, OR (US); Mitchell Thomas, Sisters, OR (US); Neil Mai, Beaverton, OR (US)

(73) Assignee: KRUGER OPTICAL, INC., Tigard, OR (US)

( * ) Notice: Subject to any disclaimer, the term of this patent is extended or adjusted under 35 U.S.C. 154(b) by 225 days.

(21) Appl. No.: 14/092,027

(22) Filed: Nov. 27, 2013

(65) Prior Publication Data

US 2015/0143733 A1 May 28, 2015

(51) Int. Cl.
*G02B 23/00* (2006.01)
*F41G 1/38* (2006.01)

(52) U.S. Cl.
CPC ..... *F41G 1/38* (2013.01)

(58) Field of Classification Search
CPC F41G 1/38; F41G 3/12; G02B 23/145; G02B 23/16; G02B 7/00; G02B 7/04; G02B 23/00; B29C 53/582; B29D 23/001
See application file for complete search history.

(56) References Cited

U.S. PATENT DOCUMENTS 3,121,134 A 2/1964 Heinzel
3,495,627 A 2/1970 Pierpont
3,696,516 A 10/1972 Thompson
3,902,251 A * 9/1975 Ross ..... F41G 1/38 33/298
4,849,150 A 7/1989 Kittaka et al.
4,950,064 A 8/1990 Akin, Jr.
7,676,137 B2 3/2010 Schick
2002/0191282 A1 12/2002 Edwards
2006/0066963 A1* 3/2006 Sudoh ..... G02B 7/022 359/819
2006/0262391 A1* 11/2006 Thomas ..... F41G 1/38 359/422
2008/0218881 A1 9/2008 Regan et al.
2009/0038203 A1* 2/2009 McCarty ..... F41G 1/383 42/147
2010/0032081 A1* 2/2010 Green ..... B29C 47/0014 156/219
2010/0170136 A1 7/2010 Buckingham
2011/0041377 A1* 2/2011 Thomas ..... F41G 1/345 42/120
2011/0232152 A1 9/2011 Thomas et al.
(Continued)

OTHER PUBLICATIONS http://www.merriam-webster.com/dictionary/adhere, Merriam-Webster, Simple Definition of Adhere.*

*Primary Examiner* — Scott J Sugarman
*Assistant Examiner* — Balram Parbadia
(74) *Attorney, Agent, or Firm* — Timothy E. Siegel Patent Law, PLLC; Timothy E. Siegel

(57) ABSTRACT

A method of producing a rifle scope having a body made in part of composite material. The method utilizes a composite material tubular housing element, having a rear and having an outer diameter and a metal eyepiece adapter in form of a tube having an inner diameter matching the outer diameter. In the method, the metal eyepiece adapter is adhered partially over the rear of the tubular housing element.

11 Claims, 10 Drawing Sheets

(56) References Cited

U.S. PATENT DOCUMENTS

| | | | | |
|---|---|---|---|---|
| 2012/0061131 | A1* | 3/2012 | Lee | B32B 15/08<br>174/257 |
| 2013/0212922 | A1* | 8/2013 | Thomas | F41G 1/065<br>42/119 |
| 2014/0218718 | A1* | 8/2014 | Mander | G01N 21/31<br>356/51 |

* cited by examiner

RIFLE SCOPE HAVING A HOUSING MADE IN PART OF COMPOSITE MATERIAL AND IN PART OF METAL

BACKGROUND

The invention is generally in the field of optical devices. More specifically, one form of the invention is a rifle scope made in part of composite material.

The traditional rifle sighting system body is a tube made of steel or aluminum, having an expanded front (objective) and rear (ocular) section. Although this design has many advantages, this results in a heavier rifle scope than is ideal for some applications.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a method of producing a rifle scope having a body made in part of composite material. The method utilizes a longitudinal inner molding core (henceforth, "spud"), separable into a front piece and a rear piece, and which has a rigid-material tube placed where the front piece joins the rear piece. Woven-fiber material is placed about the spud and the rigid-material tube, thereby creating a work piece, which is placed into a mold. A charge of resin is introduced into the mold, which is then closed. The workpiece is heated until the resin infuses the woven-fiber material. The resin is permitted to cure, thereby creating a composite material piece. The mold is opened, either before or after the resin fully cures, and the workpiece is removed. The front piece is pulled from the front of the composite material shell and the rear piece is pulled from the back of the composite material shell, leaving the rigid-material tube contained within and connected to the composite material shell. The composite material shell is then used as a part in the construction of a rifle scope.

In a second separate aspect, the present invention may take the form of a method of producing a rifle scope having a body made in part of composite material. The method utilizes a composite material tubular housing element, having a rear and having an outer diameter and a metal eyepiece adapter in the form of a tube having an inner diameter matching the outer diameter. In the method, the metal eyepiece adapter is adhered partially over the rear of the tubular housing element.

In a third separate aspect, the present invention may take the form of an optical assembly that includes a compound material tubular housing element and a set of metal tube elements, into which are seated lens groups, adhered within the compound material tubular housing element, thereby forming an optical train.

In a fourth separate aspect, the present invention may take the form of a rifle scope having a front and a rear and including a main tube made of composite material. A zoom and erector assembly is positioned mostly in the main tube and a metal eyepiece adapter is rigidly attached to the rear of the main tube, and is adapted to brace the zoom and erector assembly against forward movement relative to the main tube, during rifle recoil. Finally, an eyepiece is rigidly attached to the rear of the eyepiece adapter.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Definitions:

When the term "metal" is used as a modifier in this application, it means that the item that is the object of the modifier is largely metal, but could include other materials as well.

The term "spud" means inner molding core.

When the term "composite material" is used in this application, it means an engineered material made from two or more constituent materials with significantly different physical properties which remain separate and distinct within the finished structure. The term includes materials that combine a substrate of woven fibers, infused with a resin. The woven fibers may be made from carbon fibers, basalt fibers, glass fibers or para-aramid synthetic fibers. The resin may include an epoxy, polyester, nylon or vinyl ester. Also included are laminated materials made, at least in part, of composite material layers, and which may have a first layer or set of layers, made of a first composite material, and a second layer or set of layers, made of a second composite material. The term "composite-material" is a modifier indicating that the object of the modification interfaces with composite material.

The term "intermediate focus lens" refers to a Petzval lens or a Barlow lens placed between the objective lens and the erector tube.

Figure 1:
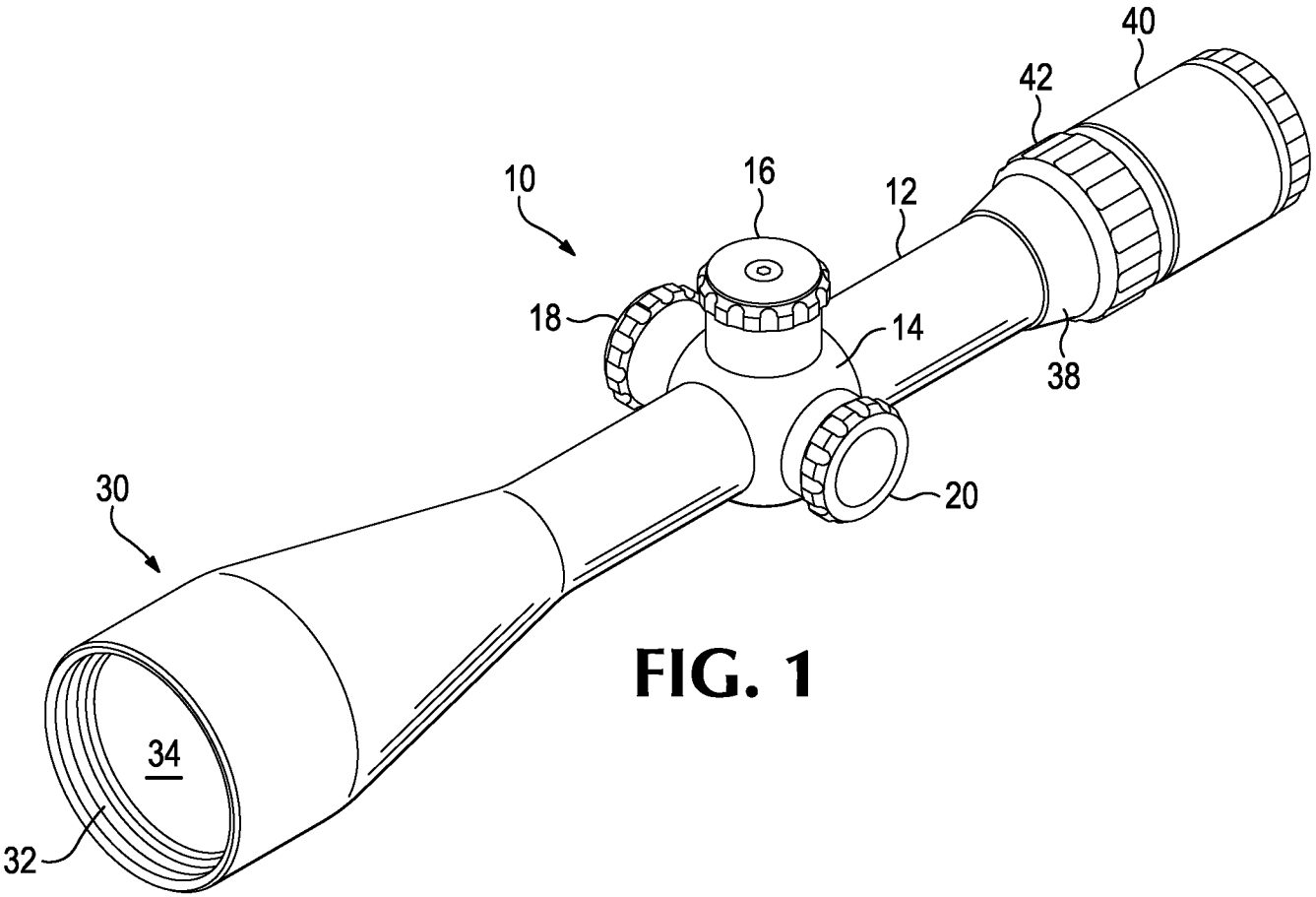
FIG. 1 is a top side perspective view of a rifle scope, made in part of composite material, according to the present invention.

Referring to FIG. 1 in one preferred embodiment the present invention takes the form of a rifle scope 10, having a composite fiber main tube 12, which supports a turret 14 having an elevation adjustment knob 16, a windage knob 18 and a focus knob 20. Although it is not visible in FIG. 1 an intermediate focus lens holder is supported inside tube 12 directly in front of the turret 14, and in turn supports an intermediate focus lens set. A fiber optic objective bell 30, similarly supports an objective lens holder 32 that supports an objective lens assembly 34. Also, at the rear of scope 10, an eyepiece adapter 38 supports eyepiece 40 and a zoom adjustment ring 42.

Figure 2:
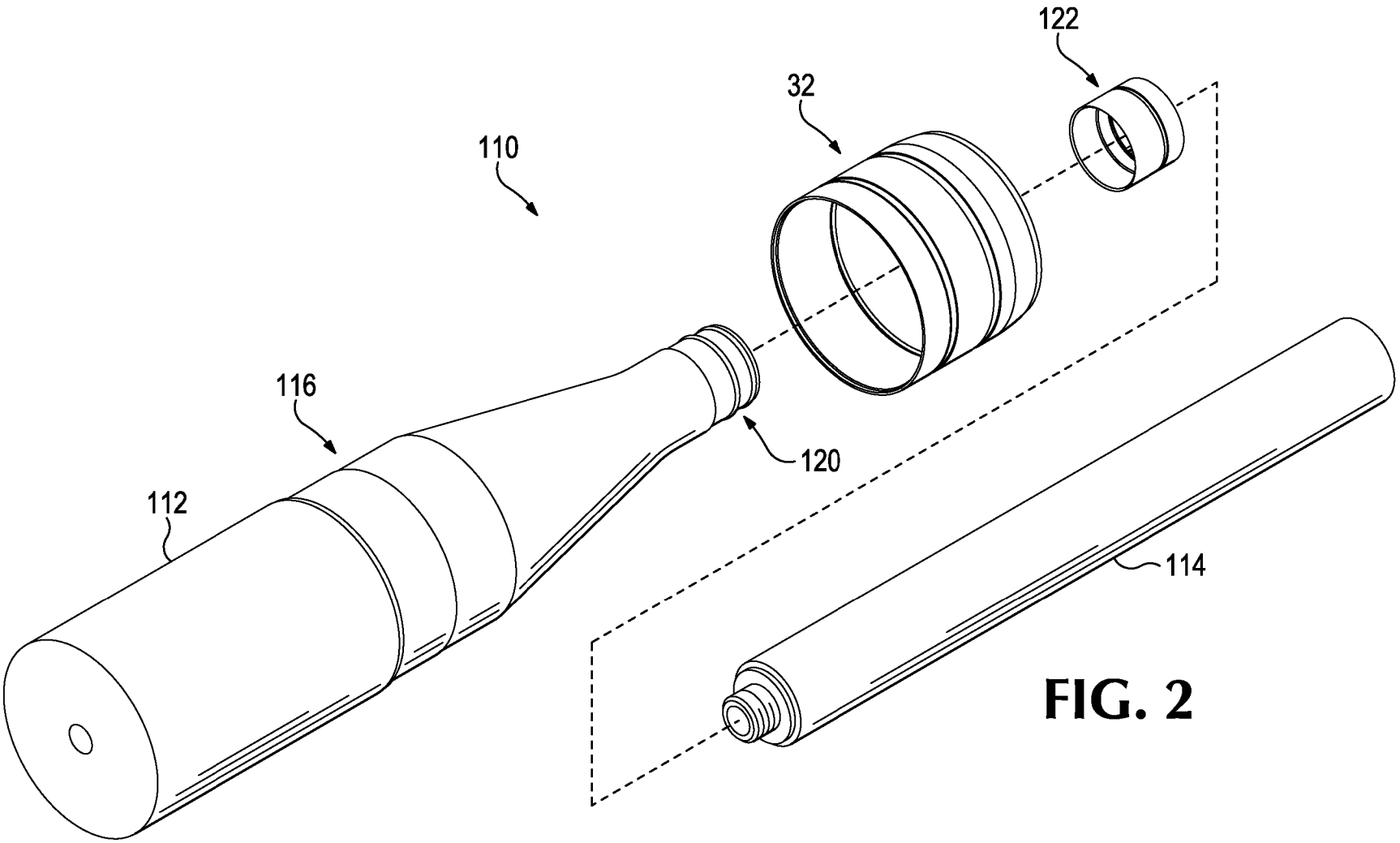
FIG. 2 is an isometric, exploded view of a work piece that may be used in the manufacture of the scope of FIG. 1.
Figure 3:
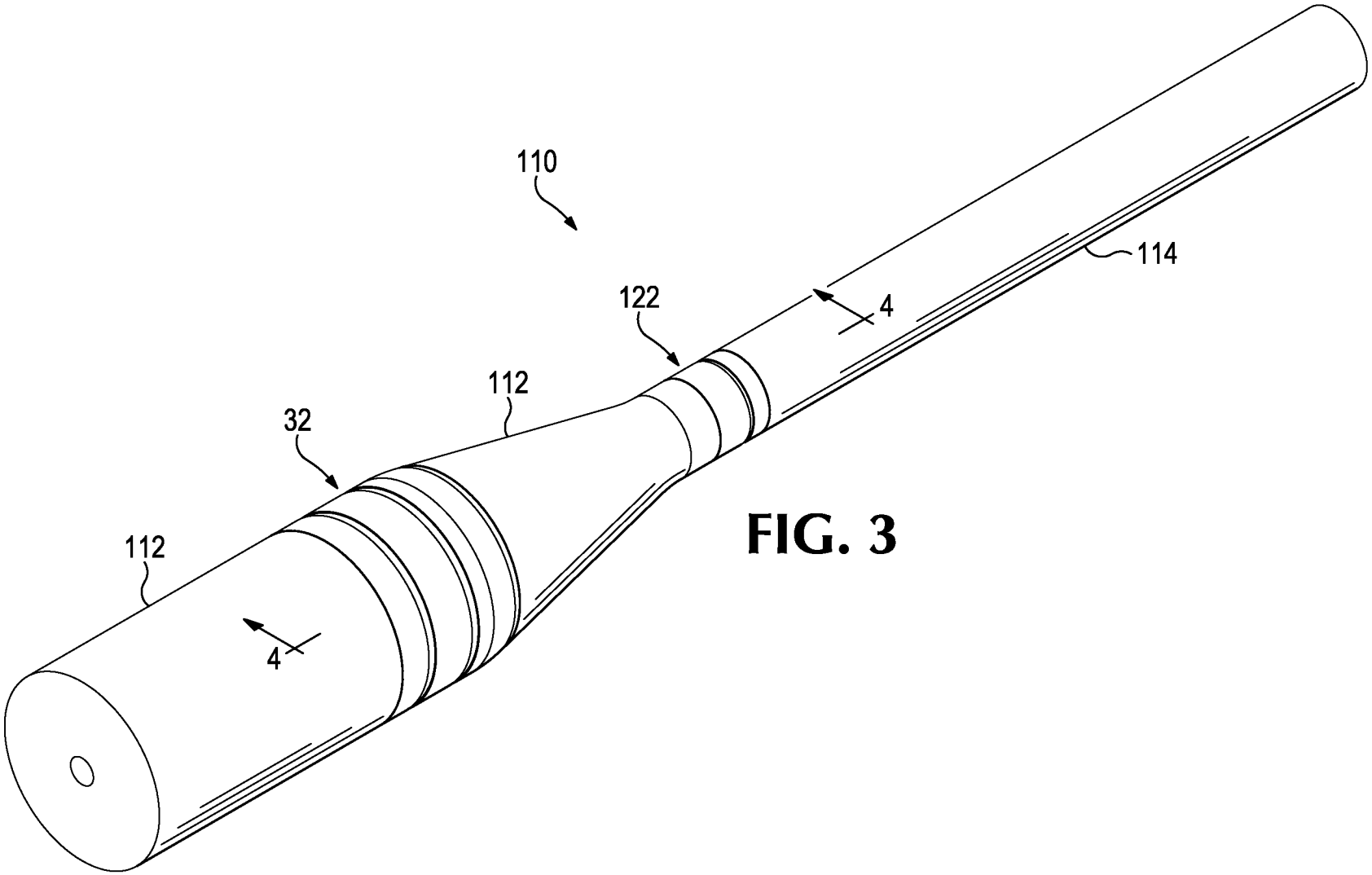
FIG. 3 is a perspective view of the workpiece of FIG. 2.

Referring, now, to FIGS. 2-3, which collectively show a stage in the construction of scope 10, a rifle scope is formed by first providing a spud 110, generally in the shape of a scope, and divided into a front spud piece 112 and a rear spud piece 114. An objective section 116 of front spud piece 112 is shaped to receive and support an objective lens insert 32. In similar manner, an intermediate focus portion 120 at the rear of front spud piece 112, is shaped to receive an intermediate focus assembly support insert 122. Both the objective assembly support insert 32 and the intermediate focus assembly support insert 122 are each designed to receive a corresponding lens assembly and to act as an interface between the composite material shell described below and these lens assemblies.

Figure 4:
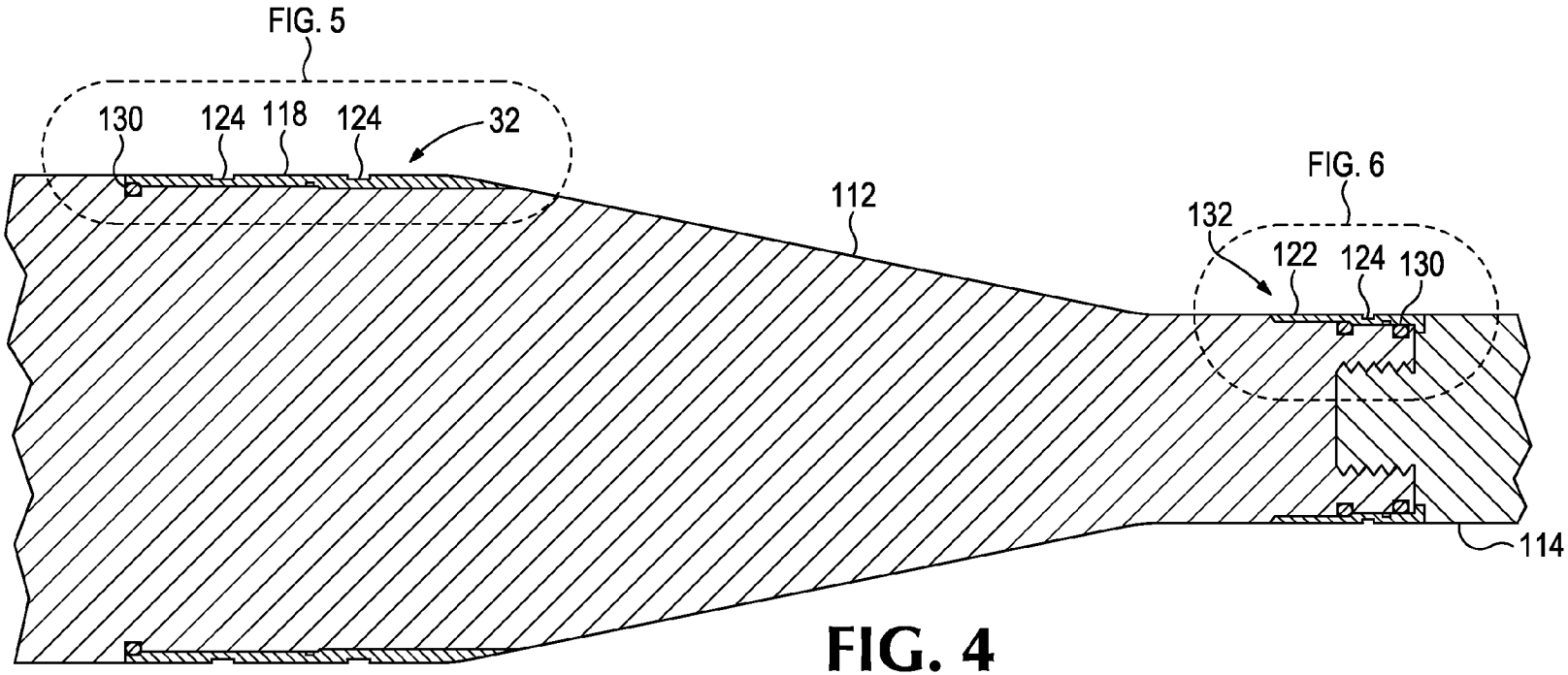
FIG. 4 is a sectional view of the front portion of the workpiece of FIG. 3.
Figure 6:
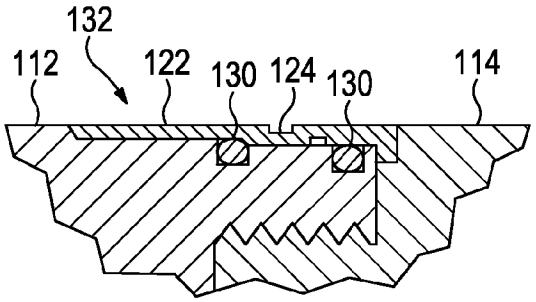
FIG. 6 is a detail view of the area shown by circle 6 in FIG. 4.
Figure 5:
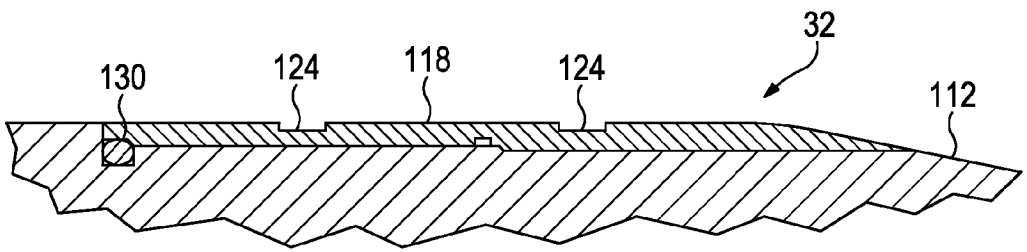
FIG. 5 is a detail view of the area shown by circle 5 in FIG. 4.

Referring to FIGS. 4, 5 and 6, a set of circular grooves 124 are defined on both the objective insert 32 and the intermediate focus insert 122. Also, O-rings 130 are set about front spud piece 112 prior to threading inserts 32 and 122 onto piece 112. Also, it can be noted that front spud 112 and rear spud 114 are joined together by means of matching threads 132.

Figure 7:
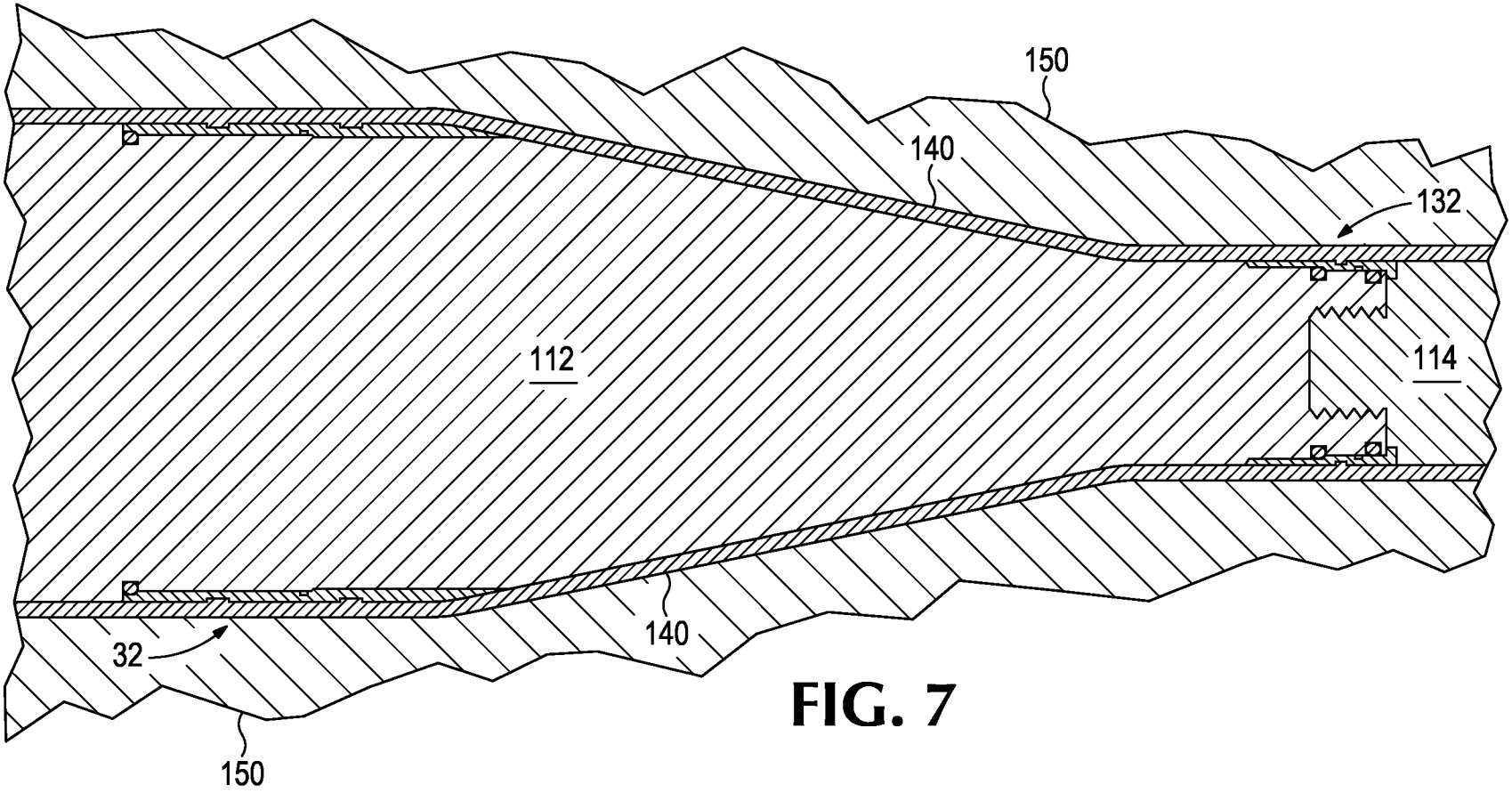
FIG. 7 is a sectional view of the front workpiece portion shown in FIG. 4, at a further stage of the production process, with composite material placed over it and placed into a mold.

Referring now to FIG. 7, a covering 140 of woven material, woven preferably of basalt or carbon fibers is placed about spuds 112 and 114 and the resultant work piece is placed into a mold 150. A charge of resin, preferably epoxy, is also placed into the mold 150 and the work piece is heated to cure the resin charge. The resin must be added and the mold 150 heated and handled so as to cause the resin to cover, and to become thoroughly inculcated into, the woven material of covering 140.

In a preferred embodiment woven material that has been pre-impregnated with resin ("prepreg" in industry parlance) is used. In one preferred embodiment a particular prepreg available from TCR composites of Ogden, Utah, designated as AS4D/UF3325, fiber volume 60%, is used. The "AS4D" portion of this designator refers to a carbon fiber that is available under the HexTow® mark from HexCel Corporation of Stamford, Connecticut. The "UF3325" portion refers to a proprietary TCR composites resin, with the following properties for the neat resin (properties of the essential polymers of the resin):

Tg (RDS G"): 255° F. (123.89° C.)
Tensile strength: 10.5 ksi
Tensile modulus: 406 ksi
Elongation: 4.6%
Density (cured): 1.208 g/cc Where $T_g$ is the glass transition temperature.

In a preferred embodiment this prepreg is placed about the spud and baked at an increasing temperature for two hours, at which point it should reach 300° F., at which temperature it is baked for two hours more and then permitted to slowly cool for two hours.

The finished product has approximately the following properties:

Tensile strength: 315 ksi
Tensile modulus: 21.7 msi
Elongation: 1.3%
NOL short beam shear: 7.6 ksi
Typical pressure vessel hoop fiber strength translations: 80 to 95%

Figure 8:
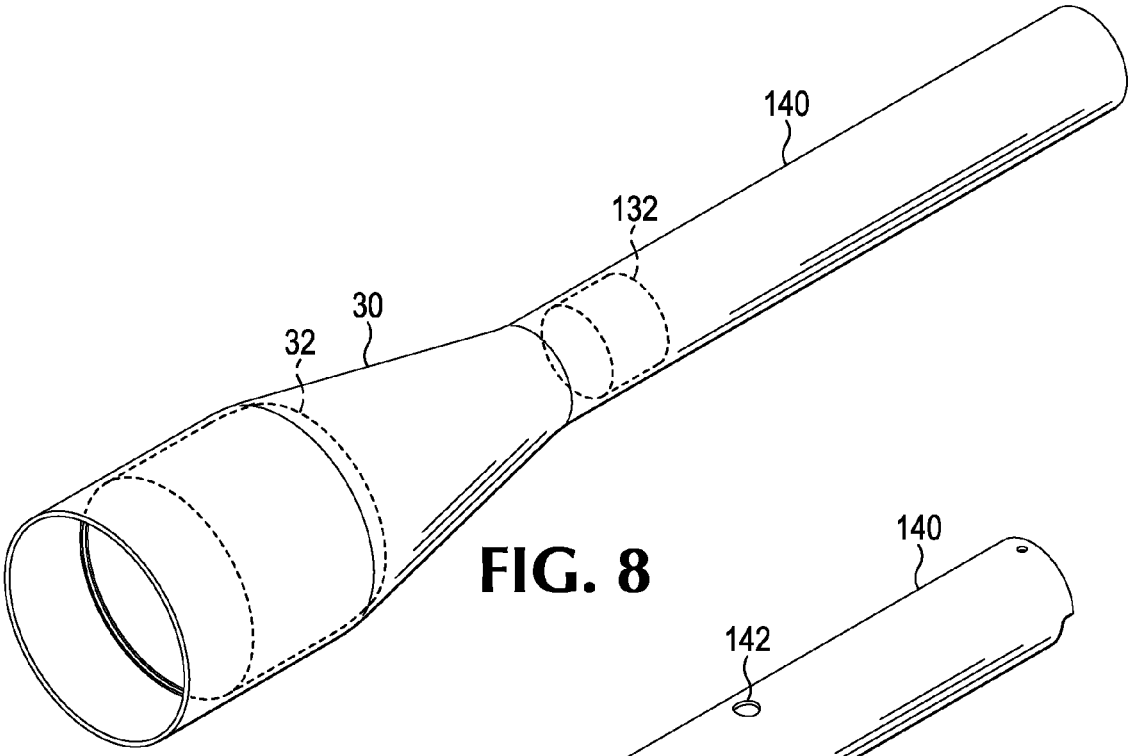
FIG. 8 shows an isometric view of the workpiece of FIG. 7, at a further point in the manufacturing process, where it has been removed from the mold and the spud has been removed.
Figure 11:
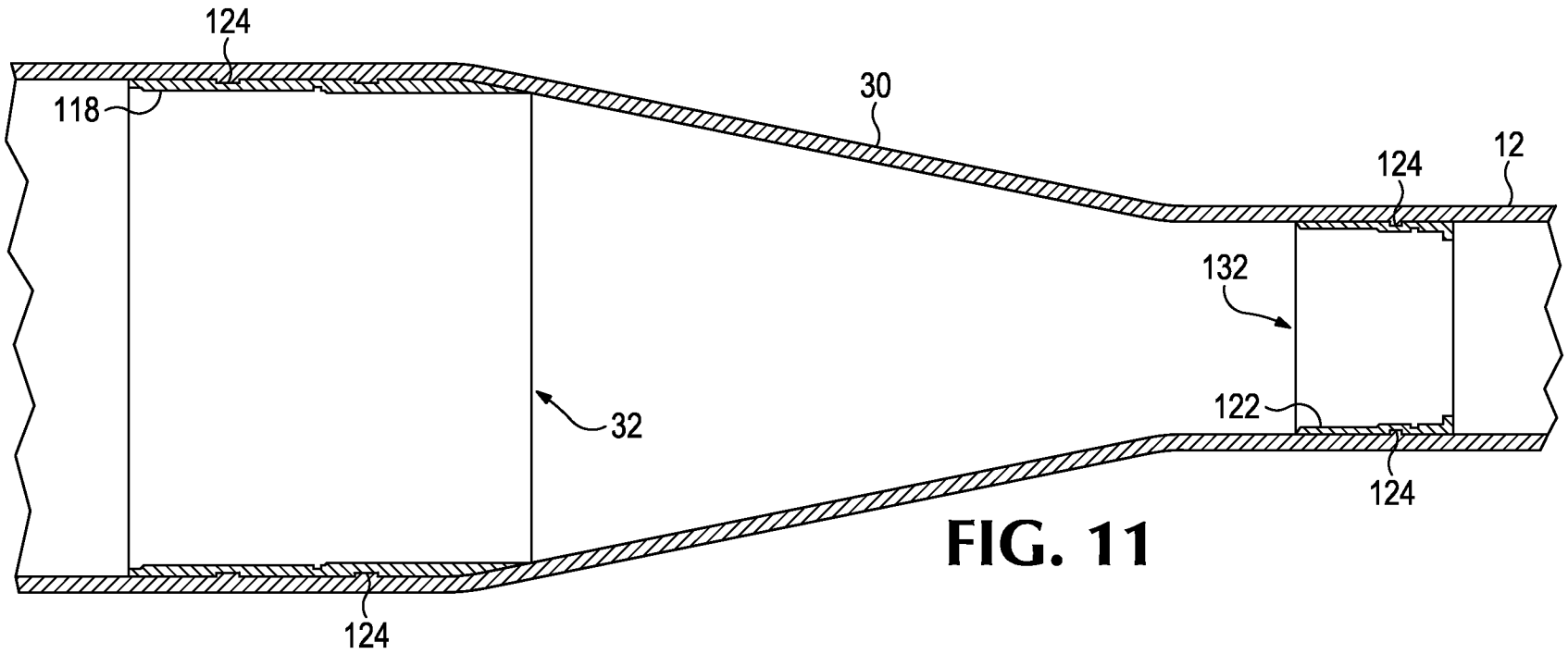
FIG. 11 shows a sectional view of the workpiece of FIG. 10.

FIGS. 8 and 11, show the work piece after it has been removed from the mold, the spuds 112 and 114 have been removed and excess covering 140 has been removed from the front. The covering 140 is now made of composite material, formed by resin curing and joining with the woven material and forms the main tube 12 and objective bell 30. Inwardly directed ridges of the composite material covering 140 have entered the circular grooves 124, thereby forming an enhanced bond between bell 30 and objective insert 32 and between main tube 12 and intermediate focus insert 124. In an alternative preferred embodiment grooves are formed on the exterior of bell 30 and main tube 12, where composite material has been introduced into grooves 124.

Figure 9:
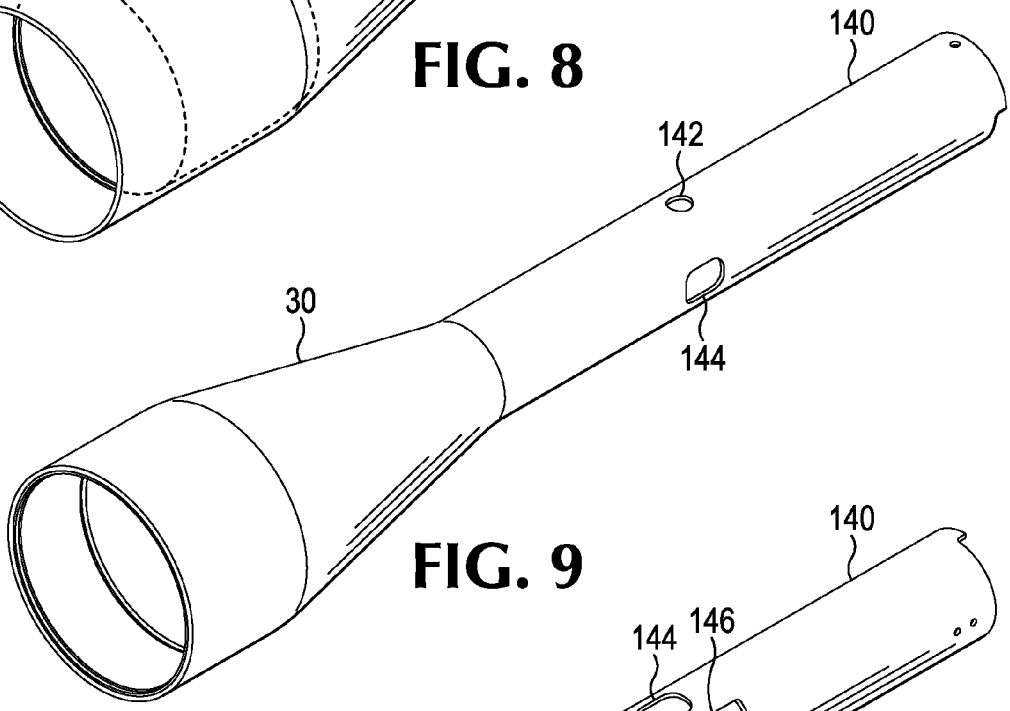
FIG. 9 is an isometric view of the workpiece of FIG. 8, at a further point in the manufacturing process, showing some apertures that have been formed in it.
Figure 10:
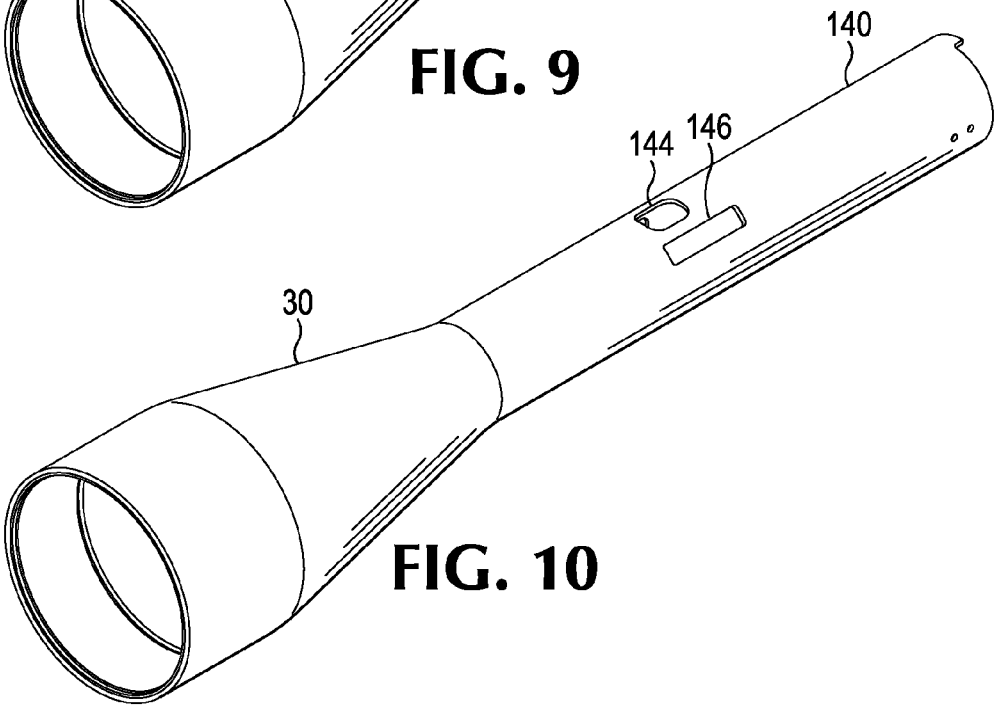
FIG. 10 is an isometric view of the workpiece of FIG. 8, rotated about its longitudinal axis, to show an additional aperture.
Figure 15:
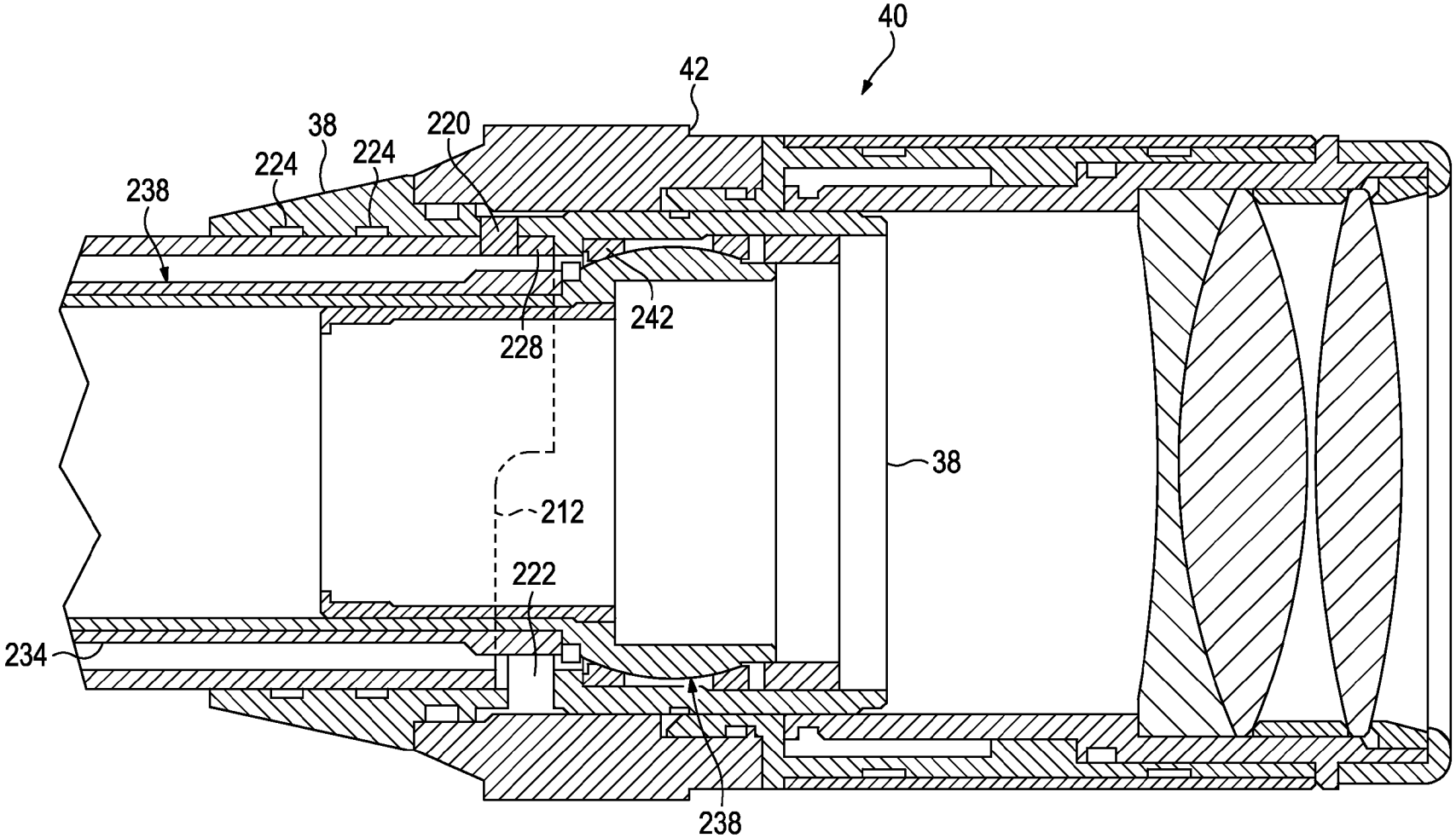
FIG. 15 shows an enlarged sectional view of the portion of FIG. 14, at a later stage of the manufacturing process, in which a zoom tube and an eyepiece have been added.

FIGS. 9 and 10 show openings 142, 144 and 146 cut into main tube 12 to accommodate an elevation adjust knob stem, focus knob stem and windage/elevation adjust resistance spring (not shown), respectively. Windage/elevation adjust resistance spring (the "spring") resists the erector tube (not shown) being pushed by the elevation adjust knob 16 or the windage adjust knob 18, and urges erector tube to move when knob 16 or 18 are moved so as to retract the movement (not shown) used to adjust windage or elevation angle. The turret 14 (FIG. 1) slides over opening 144 so that the spring does not protrude entirely through opening 144, but rather a portion of the spring (in leaf form) lies within opening 144 contacting an interior surface of turret 14. Accordingly, more space is made available inside main tube 12, compared to a scope in which there is no opening 144 and the corresponding spring must be entirely accommodated within main tube. This added space may be exploited in various ways, including in one embodiment, by making thicker the walls of the cam tube 234 (FIG. 15).

Figure 12:
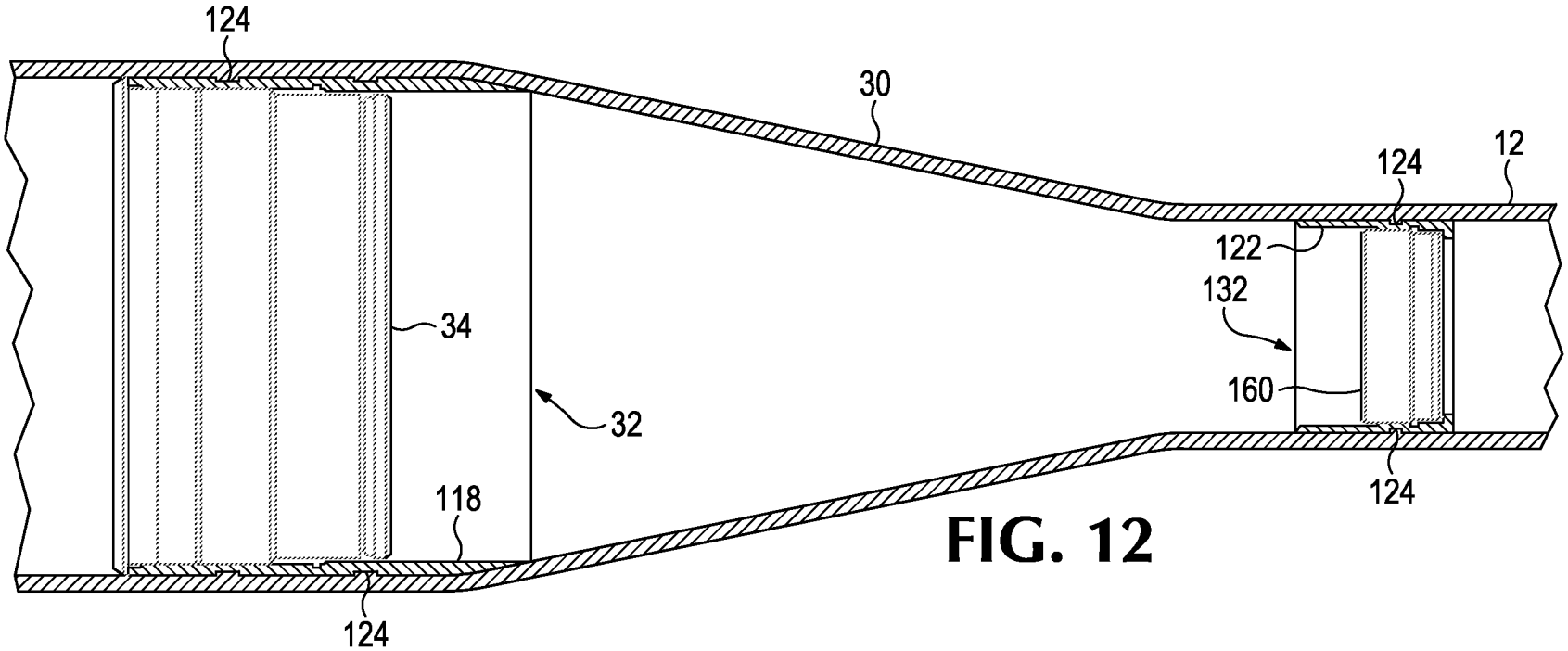
FIG. 12 shows the sectional view of FIG. 11, at a further point in the manufacturing process wherein lens assemblies have been added.

Next, referring to FIG. 12, main tube 12 is stood on end, with bell 30 pointed upward, and adhesive is introduced into the inside of intermediate focus insert 122 and objective insert 32. Alternatively, or additionally, adhesive is applied to the exterior of an intermediate focus lens assembly 160 and an objective lens assembly 34 Then the intermediate focus lens assembly 160 and the objective lens assembly 34, are lowered into intermediate focus insert 122 and objective insert 32, respectively, and adhered into place. Interior ridges 172 and 174 of insert 122 are interior surface features adapted to enhance the bonding of the intermediate focus lens assembly.

Figure 13:
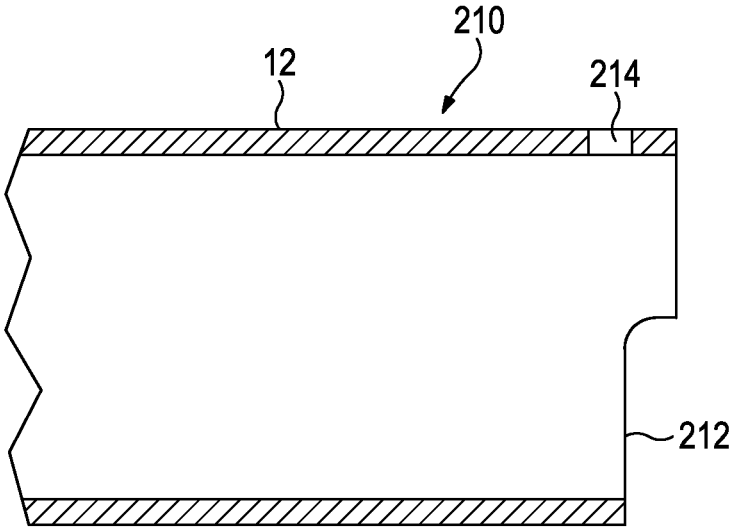
FIG. 13 shows a sectional view of a portion of composite material formed around the rear of the spud shown in FIG. 2
Figure 14:
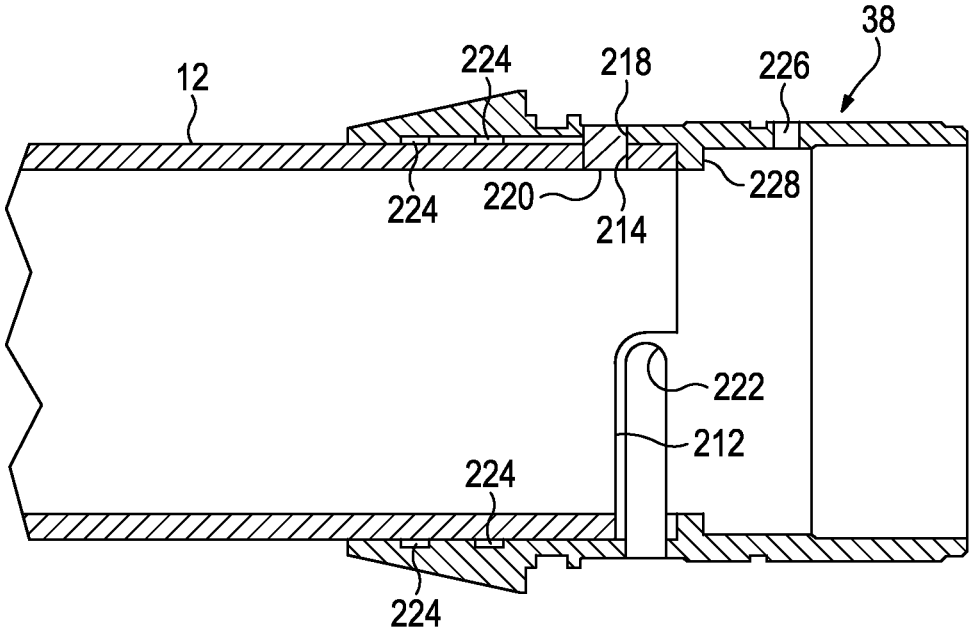
FIG. 14 shows an enlarged sectional view of the composite material portion of FIG. 13, at a later stage of the manufacturing process with an eyepiece adapter added.

FIG. 13 shows the rear end 210 of main tube 12 after it has been formed. In addition, a cut 212 has been made from the bottom and a round aperture 214 has been formed at its top. Referring to FIG. 14 an eyepiece adapter 38 is adhered to the rear. Adapter 38 defines an aperture 218 that matches aperture 214, and is aligned to aperture 214 to effect the alignment of adapter 38. A peg 220 is adhered through both aperture 214 and 218 to maintain this alignment. A slot 222 is defined in adapter 38, and will be discussed further below. Also, a set of square circumferential notches 224 are formed in the interior of adapter 38, to accommodate adhesive during the process of adhering adapter 38 to main tube 12. An inner circumferential rim 228 braces adapter 38 against the rear of main tube 12.

FIG. 14 shows the portion of FIG. 13, but with an eyepiece 40 attached and with interior elements shown, although some are not shown, for clarity of presentation. When a rifle is fired, it undergoes a sudden rearward acceleration (typically referred to "recoil" or "kickback") which is transferred to the rifle scope through the mounting mechanism (typically tubes). For scope 10, this force is transferred from main tube 12 to the eyepiece 40 and to an erector tube assembly 238 (FIG. 15), through the eyepiece adapter 38. Because of inertia, eyepiece 40 and assembly 238 effectively exert forward force, by resisting the sudden rearward acceleration, during recoil. Accordingly adapter 38 braces assembly 238 against forward motion relative to main tube 12. Many features of the design of adapter 38 and its joinder with tube 12 and eyepiece 40, and the seating of the rear portion of assembly 238, are designed to absorb the impact of recoil without suffering damage.

The erector tube assembly, 238 includes a cam tube 234 that is rotated by a zoom adjust actuator assembly, that includes a zoom adjustment ring 42 and a stem (not shown) that extends through slot and is joined with tube 234. A ring 242 has an inner curved surface that matches an outer curved surface of a rear portion of assembly 238, thereby permitting assembly 238 to swivel. Ring 242 is held in place during rifle recoil by the inner rim 228 defined by adapter 38, and in turn restrains assembly 238 from forward movement relative to main tube 12, which is rapidly accelerated rearward.

In a preferred embodiment inserts 32 and 122 and adapter 38 are made of 6061 aluminum alloy. Among other functions, insert 32 and adapter 38 serve to form a robust seal between composite material covering 140 and the interior elements of the scope 10, thereby protecting the scope interior from moisture damage and other possible contamination.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A rifle scope, comprising:

(a) a unitary composite material tubular housing element, formed of a woven fiber material impregnated with a cured resin;

(b) a set of metal tube elements adhered by said cured resin within and to said composite material tubular housing element;

(c) one of said metal tube elements supporting an objective lens assembly at an objective end of said rifle scope;

(d) one of said metal tube elements supporting an intermediate focus lens assembly, inward of said objective lens, in said composite material tubular housing element; and (e) lens group assemblies, seated in said metal tube elements, thereby forming an optical train.

2. The rifle scope of claim 1 having a front and a rear, and wherein:

(a) said composite material tubular housing element includes a main tube made of composite material, and having a front and a rear;

(b) and said optical assembly further includes:

(i) a zoom and erector assembly positioned mostly in said main tube;

(ii) a metal eyepiece adapter rigidly attached to said rear of said main tube, and adapted to brace said zoom and erector assembly against forward motion relative to said main tube, during rifle recoil; and (iii) an eyepiece rigidly attached to said eyepiece adapter, such that said eyepiece is not permitted to move relative to said main tube.

3. The rifle scope of claim 2, wherein said eyepiece adapter includes a circumferential through-slot, and further including a zoom adjust actuator assembly that includes a post extending through said circumferential slot to permit zoom adjustment, by moving said pin circumferentially in said slot.

4. The rifle scope of claim 2, wherein said eyepiece adapter fits over the rearmost centimeter of said main tube.

5. The rifle scope of claim 2, wherein said eyepiece adapter is adhered by resin to said main tube.

6. The rifle scope of claim 2, wherein said eyepiece is fit over the rearmost centimeter of said eyepiece adapter.

7. The rifle scope of claim 2, wherein said main tube and said eyepiece overlap each other in longitudinal dimension of said rifle scope, about said eyepiece adapter.

8. The rifle scope of claim 1, wherein said cured resin is a cured epoxy.

9. The rifle scope of claim 1, wherein said woven fiber-material is carbon fiber material.

10. The rifle scope of claim 1, wherein said woven fiber-material is basalt fiber material.

11. The rifle scope of claim 1, further including an erector tube and wherein said intermediate focus lens assembly is separate and displaced from said erector tube.

* * * * *